US005727809A

United States Patent [19]

Ordelman et al.

[11] Patent Number: 5,727,809

[45] Date of Patent: Mar. 17, 1998

[54] COLLAPSIBLE WHEELCHAIR

[76] Inventors: Hendrik Jan Ordelman, Bosstraat 13, NL-7161 XX Neede; Gerhard Temmink, Wiedenbroeksingel 32, NL-7481 BT Haaksbergen; Herman Willem Hendrik Stokkers, Vonkenkaamp 3, NL-7482 GB Haaksbergen; Harm Hendrik Braam, Spoelsterstraat 6, NL-7481 KG Haaksbergen, all of Netherlands

[21] Appl. No.: 556,617

[22] Filed: Nov. 13, 1995

Related U.S. Application Data

[63] Continuation-in-part of PCT/NL94/00275, Jul. 11, 1994.

[30] Foreign Application Priority Data

Nov. 15, 1993 [NL] Netherlands ..... 9301970

[51] Int. Cl.[6] ..... A61G 5/08

[52] U.S. Cl. ..... 280/650; 280/250.1

[58] Field of Search ..... 280/250.1, 639, 280/647, 650, 47.34, 47.38, 47.4

[56] References Cited

U.S. PATENT DOCUMENTS

| | | | |
|---|---|---|---|
| 2,427,782 | 9/1947 | Hausman | 280/250.1 X |
| 2,592,025 | 4/1952 | Gray | 298/DIG. 4 X |
| 2,927,631 | 3/1960 | Andersson et al. | 297/DIG. 4 X |
| 3,887,228 | 6/1975 | Ingerson | 297/DIG. 4 X |
| 3,968,991 | 7/1976 | Maclaren | 280/250.1 X |
| 3,976,152 | 8/1976 | Bell | 280/250.1 X |
| 4,199,036 | 4/1980 | Wereb | 180/6.5 |
| 4,322,093 | 3/1982 | Otto | 280/650 |
| 4,385,769 | 5/1983 | Molino | 280/47.38 |
| 4,428,594 | 1/1984 | Minnebraker | 280/250.1 |
| 4,436,320 | 3/1984 | Brudermann et al. | 280/250.1 |
| 4,607,860 | 8/1986 | Vogel | 280/650 |
| 4,679,816 | 7/1987 | Riikonen | 280/650 |
| 4,684,171 | 8/1987 | Roy et al. | 280/250.1 X |
| 4,687,218 | 8/1987 | Okamoto | 280/250.1 |
| 4,693,490 | 9/1987 | Loodberg et al. | 280/650 |
| 4,697,823 | 10/1987 | Kassai | 280/644 |
| 4,736,960 | 4/1988 | Batty et al. | 280/42 |
| 4,805,931 | 2/1989 | Slasor | 280/650 |
| 4,809,998 | 3/1989 | Girvin | 280/250.1 |
| 4,887,826 | 12/1989 | Kantner | 280/250.1 |
| 4,966,379 | 10/1990 | Mulholland | 280/650 X |
| 5,020,816 | 6/1991 | Mulholland | 280/250.1 |
| 5,064,211 | 11/1991 | Huttenhuis et al. | 280/250.1 |
| 5,160,156 | 11/1992 | Mendon | 280/250.1 |
| 5,244,223 | 9/1993 | Uchiyama | 280/250.1 |
| 5,401,044 | 3/1995 | Galumbeck | 280/250.1 |
| 5,480,179 | 1/1996 | Peacock | 280/650 |

FOREIGN PATENT DOCUMENTS

| | | |
|---|---|---|
| 2573304 | 3/1986 | France . |
| 2200084 | 7/1988 | United Kingdom . |

*Primary Examiner*—Kevin Hurley
*Attorney, Agent, or Firm*—Webb Ziesenheim Bruening Logsdon Orkin & Hanson, P.C.

[57] ABSTRACT

A collapsible wheelchair having a frame including a first side frame, a second side frame, coupling means holding the two side frames at least on the operative situation in the same positions at a mutual distance, wheel arranged on the frame, a seat and a back.

25 Claims, 9 Drawing Sheets

COLLAPSIBLE WHEELCHAIR

CROSS REFERENCE TO RELATED APPLICATION

This application is a continuation-in-part of International application Ser. No. PCT/NL94/00275, filed Jul. 11, 1994 and designating the United States, which corresponds to Netherlands Application NL-93 01970, filed Nov. 15, 1993.

BACKGROUND OF THE INVENTION

The invention relates to a collapsible wheelchair having a frame, a first side frame, a second side frame substantially the same as the first side frame and coupling means holding the two said side frames at least in the operative situation in the same positions at a mutual distance. Wheels, a seat and a seat back are arranged on the frame.

Wheelchairs are generally designated as either "active" or "passive" depending upon how the wheelchairs are used. An active wheelchair is a wheelchair designed to be propelled by the wheelchair user. Active wheelchairs generally have large rear wheels with a circular grip ring attached to the wheels. The wheelchair occupant propels the wheelchair himself by applying a force to the grip ring to turn the rear wheels.

On the other hand, a passive wheelchair is one designed to be pushed by a third party to transport the wheelchair occupant sitting in the wheelchair. These passive wheelchairs generally have much smaller rear wheels than the active wheelchair and usually include a bar attached to the back seat of the wheelchair for the third party to grip in propelling the passive wheelchair.

Different types of active and passive wheelchairs are known. In one known wheelchair the side frames are movable toward each other by means of a hinged cross connection by exerting an inward pressure force from the sides. In the thus obtained folded situation the wheelchair has the same dimensions in the vertical plane as in the non-collapsed state.

The invention has for its object to embody a wheelchair such that in a collapsed state it occupies considerably less effective space than known wheelchairs and for instance has dimensions such that it can be taken as hand-luggage aboard an aircraft which for obvious reasons is considerably more practical for a wheelchair user. The wheelchair user can transport himself or, if necessary, be transported with the help of a third party into the aircraft. The wheelchair can then be folded up to dimensions which are at most equal to the maximum permissible dimensions for hand-luggage. After the flight the wheelchair is again immediately available to the wheelchair user.

Also, in the case of other forms of transport such as public transport or a car, it may be desired that a wheelchair can be collapsed to comparatively small dimensions.

It is also an object of the invention to provide a wheelchair frame which can be easily and quickly adapted between an active and passive wheelchair mode. It is a further object of the invention to provide a collapsible passive wheelchair.

SUMMARY OF THE INVENTION

With a view to the above, the invention provides a collapsible wheelchair which has the feature that each side frame comprises:

a first middle sub-frame which in the operative situation extends more or less horizontally, at least roughly at the height of the seat;

a front sub-frame which in the operative situation extends from the front side of the first middle sub-frame inclining downward in forward direction and which bears a front wheel;

a rear sub-frame which in the operative situation extends from the rear side of the first middle sub-frame and bears a rear wheel;

the front and rear sub-frames are pivotable relative to the first middle sub-frame by means of a hinge joint;

the coupling means are embodied as spacers holding corresponding sub-frames at a fixed mutual distance;

a second middle sub-frame is arranged between the front and rear sub-frame for pivoting relative to both these sub-frames by means of a hinge joint such that each side frame, and thus the whole frame, can be folded round horizontal pivot axes until the three sub-frames lie at least substantially on top of each other; and stop means are present between a middle sub-frame and at least one of the other sub-frames which determine a stable operating position of the wheelchair.

It is advantageous to be able to adjust the diverse mutual relationships, in particular, the angular positions of the component parts, in accordance with the wishes of the user.

For this purpose the wheelchair can have the feature that the location of the hinge joint between the first middle sub-frame and the rear sub-frame is adjustable along that rear sub-frame.

The wheelchair can also have the feature that the location of the hinge joint between the second middle sub-frame and the front sub-frame is adjustable along that front sub-frame.

The wheelchair can have the additional feature that the length of the second middle sub-frame is adjustable.

Other than in the case of the known wheelchair briefly described above, wherein a pivotable scissor construction mutually couples the two side frames, in the wheelchair according to the invention the side frames should be as inherently stiff as possible in the vertical plane. To this end the wheelchair according to the invention can display the feature that, in the main plane of the side frame and at least in the zone adjoining the hinge joint to the front sub-frame, the first middle sub-frame has larger dimensions than in transverse direction for increasing the bending stiffness in that plane. The first middle sub-frame can, for instance, be more or less plate-like and have an increasing vertical dimension at least in the direction of its forward side. However, in order to save as much weight as possible, use can also be made of a cut-away structure.

The requirement of an increased bending stiffness also applies for the front sub-frame, but to a somewhat lesser extent. In this respect, the wheelchair can have the feature that in the main plane of the side frame, at least in the zone adjoining the hinge joint to the first middle sub-frame, the front sub-frame has a larger dimension than in transverse direction for increasing the bending stiffness in that plane.

In order to enable the easiest possible folding of the wheelchair after detaching the wheels it can display the special feature that the rear wheels are releasably coupled to the rear sub-frame by means of a rapid-action coupling.

This variant can have the particular characteristic that the rear sub-frame bears a releasable block which supports a shaft to which a rear wheel is releasably coupled, which block supports the shaft at an angle determining the alignment angle of the rear wheel.

The longitudinal position of the rear wheels is to a large extent decisive for the balance of the wheelchair. As this balance differs from user to user and may also depend on the adjustment of the diverse, mutually adjustable parts and the parts of adjustable length, the wheelchair can display the special feature that the position of the shaft is adjustable in the travel direction of the rear wheel.

In a particular embodiment, the wheelchair has the special feature that the block is hingedly connected to the second middle sub-frame and the two second middle sub-frames are mutually connected by a second spacer.

In particular, a combination of the two latter special features provides a strong and stable mechanical structure, wherein the whole space under the said two spacers is freely accessible. This may be of importance for coupling of the wheelchair to an auxiliary device such as described in applicant's earlier, as yet unpublished Netherlands patent application NL-93 01322 which is based on the European priority patent application EP-93.201601.1 of 4 Jun. 1993.

A still greater stiffness is ensured with a variant wherein the two rear sub-frames are mutually connected by a third spacer in the zone adjoining the first middle sub-frame.

A very simple, reliable embodiment of the wheelchair according to the invention has the characteristic that the stop means comprises a pin axially displaceable by means of actuating assembly or means counter to the action of spring means, which pin is mounted in a sub-frame and can be in locking co-action with a hole in an adjacent sub-frame.

The construction of the wheelchair is preferably symmetrical. In this respect, the said embodiment can have the special feature that two pins are present at corresponding positions in both its frames.

Easy to operate is the embodiment in which the two pins are connected by a flexible pulling member, for example, a cord or cable, such that by exerting a pulling force on that pulling member a user can move both pins out of their locking co-action with the respective hole counter to the action of the respective spring means.

In a preferred embodiment, the front wheels may be relatively small, i.e., smaller than the rear wheels, the rear sub-frame may incline upward in a rearward direction and adjacent rear sub-frames may support the seat back.

The invention further provides a wheelchair having a frame, a plurality of wheels rotatably secured to the frame and a seat secured to the frame. The frame includes a first member, a second member pivotally secured to the first member, a third member pivotally secured to the second member and a fourth member pivotally secured to the first member and the third member. A stop is secured to the frame. A locking member is secured to the frame whereby the frame is adapted to collapse in a first position when the first member is moved toward the third member so that portions of at least three of the members are positioned above one another without collapsing the seat. The frame is adapted to open into a second position when the first member is moved away from the third member, the stopping member preventing further movement of the frame members relative to each other and the locking member automatically engaging when the frame members are in the second position so that the frame cannot be collapsed unless the locking member is disengaged.

A passive wheel assembly is provided for converting the wheelchair between an active and passive mode. The passive wheel assembly includes a tubular support having a first end and a second end with a wheel attachment element attached to the second end of the tubular support. A wheel is rotatably attached to the wheel attachment element. A chair attachment member is attached to the first end of the tubular support and includes a front face having an attachment peg extending substantially perpendicularly therefrom and a threaded bore.

A collapsible passive wheelchair is provided in which a wheel attachment element is located on a lower end of the rear sub-frame and a passive rear wheel is rotatably carried on the wheel attachment member. An attachment tube extends from the rear sub-frame and is pivotally attached to at least one of the spacers of the wheelchair.

BRIEF DESCRIPTION OF THE DRAWINGS

The invention will now be elucidated with reference to the annexed drawings. Herein.

In all figures, the same components are designated with the same reference numerals.

DESCRIPTION OF THE PREFERRED EMBODIMENTS

Figure 1:
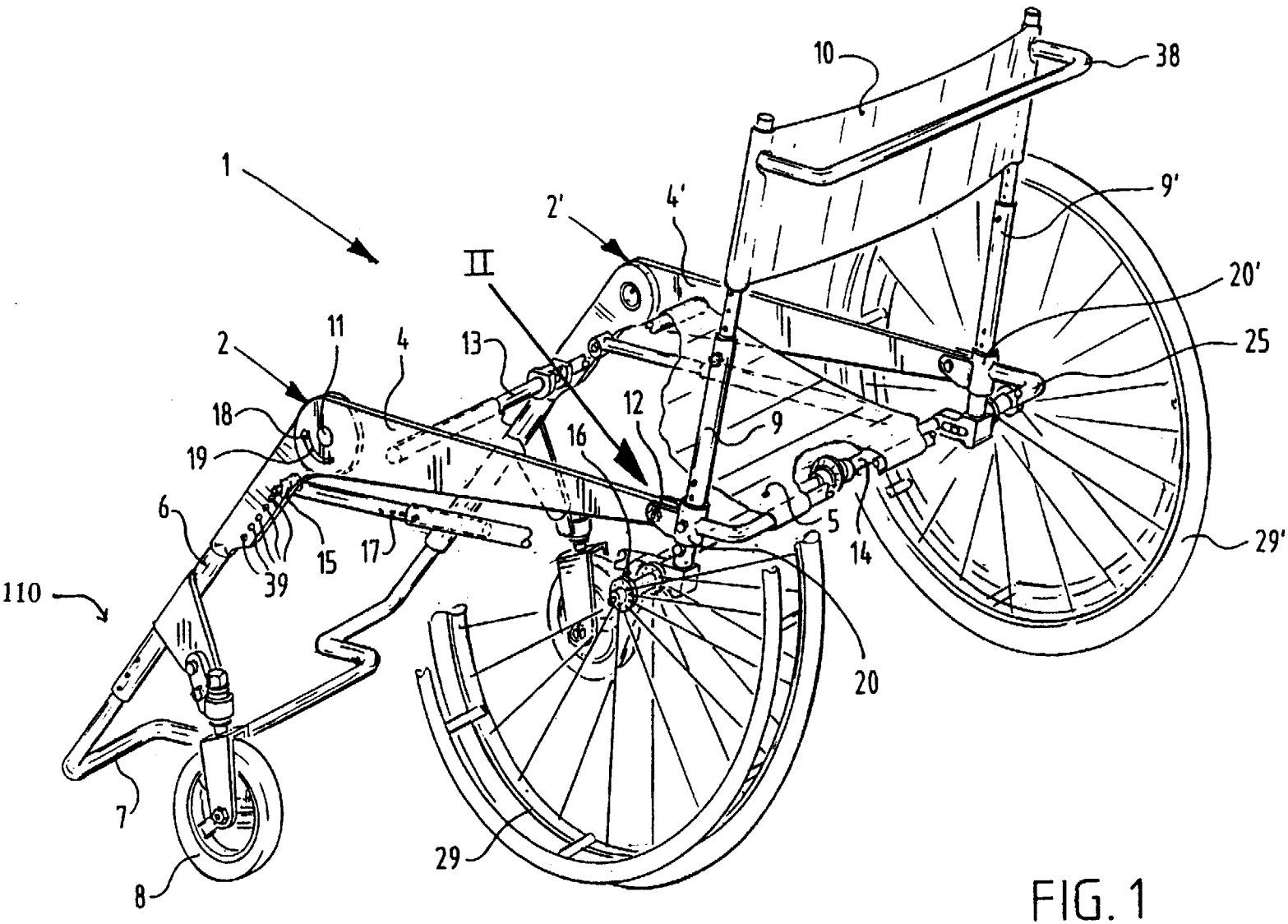
FIG. 1 shows a partly broken away perspective view of a wheelchair according to the invention.

FIG. 1 shows a collapsible wheelchair according to the invention. The wheelchair comprises a left-hand side frame 2 and a right-hand side frame 2'. These side frames 2 and 2' are the same but embody mirror symmetrically. For the sake of brevity in the description, only side frame 2 will be described where appropriate.

Side frame 2 includes a first middle sub-frame 4 which in the operative state shown in FIG. 1 extends more or less horizontally, in any case roughly at the height of a seat 5. A front sub-frame 6, in the operative situation shown in FIG. 1, extends from the front side of the first middle sub-frame 4 inclining downward in forward direction and which bears a support member 7 for a foot-rest and a relatively small pivotable front wheel 8.

A rear sub-frame 9, which in the operative situation shown in FIG. 1, extends from the rear side of the first middle sub-frame 4 inclining upward in rearward direction and bears a relatively large rear wheel 29 and together with the other rear sub-frame 9' supports a seat back 10. The front sub-frame 6 and the rear sub-frame 9 are pivotable relative to the first middle sub-frame 4 by means of respective hinge joints 11, 12. The support member 7 mutually joins the left and right-hand front sub-frames and thus contributes to the self-supporting character of the wheelchair. Rear sub-frame 9 is substantially L-shaped.

The side frames 2, 2' are connected to coupling means. These are embodied as spacers holding corresponding sub-frames at fixed mutual distance. The first middle sub-frames 4, 4' are coupled by means of a spacer 13. The rear sub-frames 9, 9' are coupled by a spacer 14. A second middle sub-frame 17 is arranged between the front sub-frame 6 and the rear sub-frame 9 for pivoting relative to both these sub-frames by means of hinge joints 15, 16 such that each side frame 2, 2', and thus the whole frame, can be folded round horizontal pivot axes until the three sub-frames 6, 4, 9; 6', 4', 9' lie at least substantially on top of each other. Four members, i.e., sub-frames 4, 6, 9 and 17, and 4', 6', 9' and 17', form a first side frame 2 or frame members 110 and a second side frame 2' or frame member 110 and 110', wherein in the first side frame 2 the first member or front sub-frame 6 is pivotally secured to the second member or first middle sub-frame 4 which is pivotally secured to the third member or rear sub-frame 9 which is pivotally secured to the fourth member or second middle sub-frame 17. The fourth member is also pivotally secured to the first member. In the second side frame 2', a fifth member or front sub-frame 6' is pivotally secured to a sixth member or first middle sub-frame 4' which is pivotally secured to a seventh member or a rear sub-frame 9' which is pivotally secured to an eight member or second middle sub-frame 17'. The seventh member is also pivotally secured to the fifth member. One of the members can be L-shaped, i.e., sub-frame 9, and defined by two legs, wherein two of the other sub-frames (17 and 4) are pivotally attached to respective legs of sub-frame 9. Present between the first middle sub-frame 4 and the front sub-frame 6 are stop means or a stop which determine a stable operating position of wheelchair 1. Connected to the front sub-frame 6 for this purpose is a pin or first stop portion 18 which is movable in a slotted hole 19 in the first middle sub-frame 4 which is concentric to joint 11. Slotted hole 19 is defined by a surface or a second stop portion 112 of sub-frame 4. When the frame is opened to an open position, the pin contacts or abuts surface 112 so that sub-frame 6 cannot be pulled further away from sub-frame 9.

The location of the hinge joint 12 between the first middle sub-frame 4 and rear sub-frame 9 is adjustable along that rear sub-frame 9. Particular reference is made in this respect to FIG. 2. A sleeve 20 is slidable along the rear sub-frame 9 and fixable relative thereto in chosen positions by means of holes 21 and a pin 22. Sleeve 20 carries two ears 23 which hingedly support the first middle sub-frame 4 by means of a bolt 24. The corresponding sleeves 20, 20' are mutually connected by a tube 25 which serves as spacer, therefore stiffens the construction and also fulfills the function of support for the seat 5 which is supported at the front by the spacer 13.

The location of the hinge joint 15 between the second middle sub-frame 17 and the front sub-frame 6 is adjustable along that front sub-frame. For this purpose, a series of holes 39 is arranged in that sub-frame 6.

Figure 2:
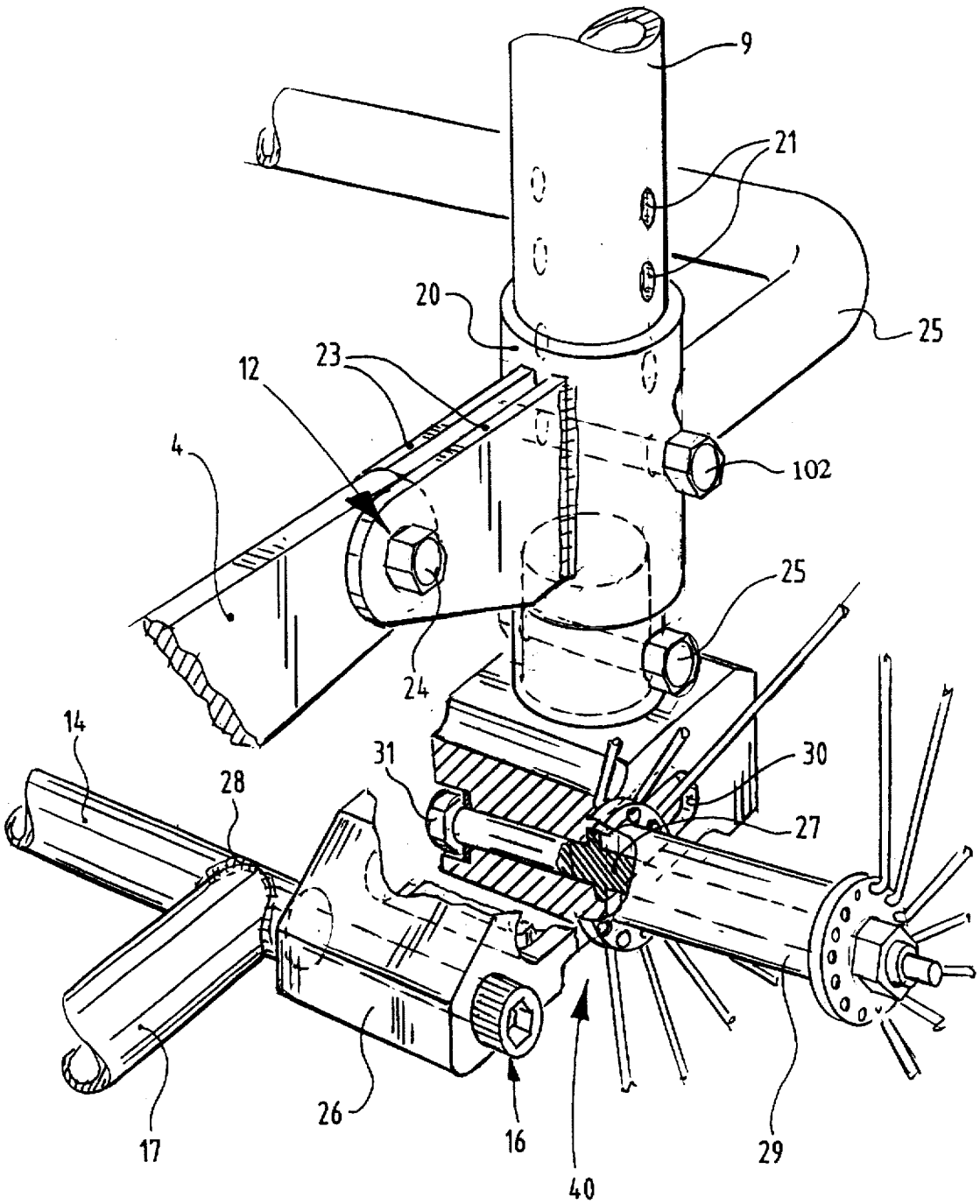
FIG. 2 shows a partly broken away perspective view on enlarged scale of the structure in the region of the coupling block for the left-hand rear wheel.

The length of the second middle sub-frame 17 is adjustable. The embodiment of this adjustability is of a per se known type, related to the adjustment of the sleeve 20 relative to the rear sub-frame 9 as shown in FIG. 2. This does not therefore require further discussion.

In a wholly analogous manner the support member 7 is adjustable relative to the front sub-frame 6.

The first middle sub-frame 4 has in the main plane of the side frame a larger dimension than in transverse direction for increasing the bending stiffness in that plane. FIG. 1 shows that the relevant dimension increases as the distance to the hinge joint 11 decreases.

The front sub-frame 6 has in the main plane of the side frame a larger dimension than in transverse direction for increasing the bending stiffness in that plane. As this front sub-frame 6 is subject to a less strong moment than the first middle sub-frame 4 the relevant dimension does not have to be as large as in the case of the first middle sub-frame 4.

The rear wheel 29 is coupled to the rear sub-frame 9 by means of a per se known rapid-action coupling 40. Particular reference is made in this respect to FIG. 2. The rear sub-frame 9 bears for this purpose a block 26 which is releasably coupled thereto by means of a bolt 102 and which supports a shaft 27 to which the rear wheel 29 is detachably coupled by means of rapid-action coupling 40. The block 26 carries the shaft 27 at an angle determining the alignment angle of rear wheel 29. Block 26 carries the spacer 14 pivotally. The second middle sub-frame 17 is connected to spacer 14 by means of a weld joint 28. The position of shaft 27 is adjustable at least roughly in the travel direction of the rear wheel 29. To this end the block 26 is provided with a slotted hole 30 in which shaft 27 is slidable. Fixation in a desired position takes place by means of a nut 31. The block 26 is easily detachable so that if desired it can be replaced with another block with which a user can obtain another desired alignment angle of rear wheel 29.

Figure 3:
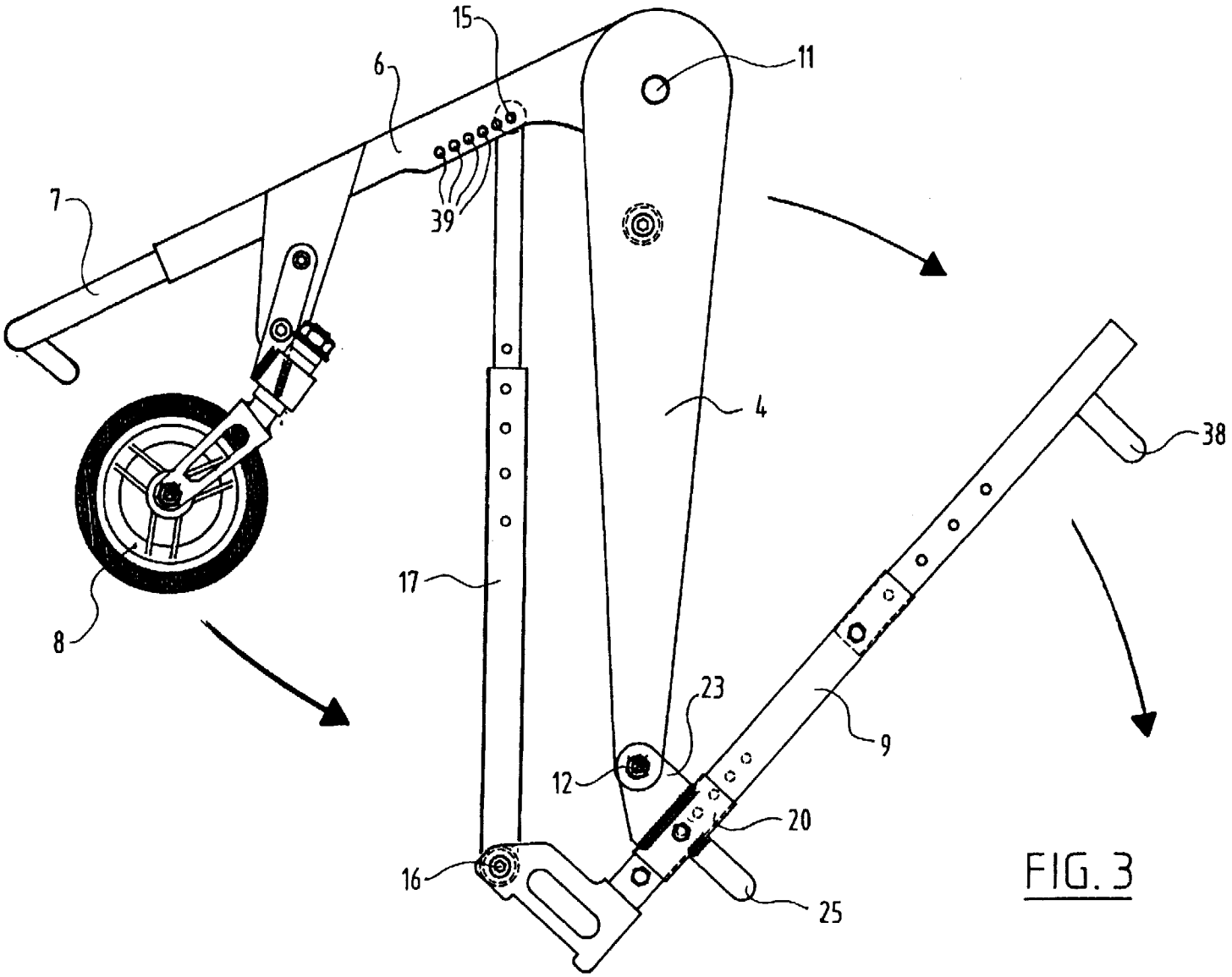
FIG. 3 is a schematic side view of the wheelchair in which the manner of folding is indicated.

FIG. 3 shows a side view of wheelchair 1 elucidating the manner in which folding takes place. It will be apparent that the respective sub-frames 9, 4, 6, 17 can be folded while pivoting mutually until they assume a mutual position occupying the minimum space.

Figure 4:
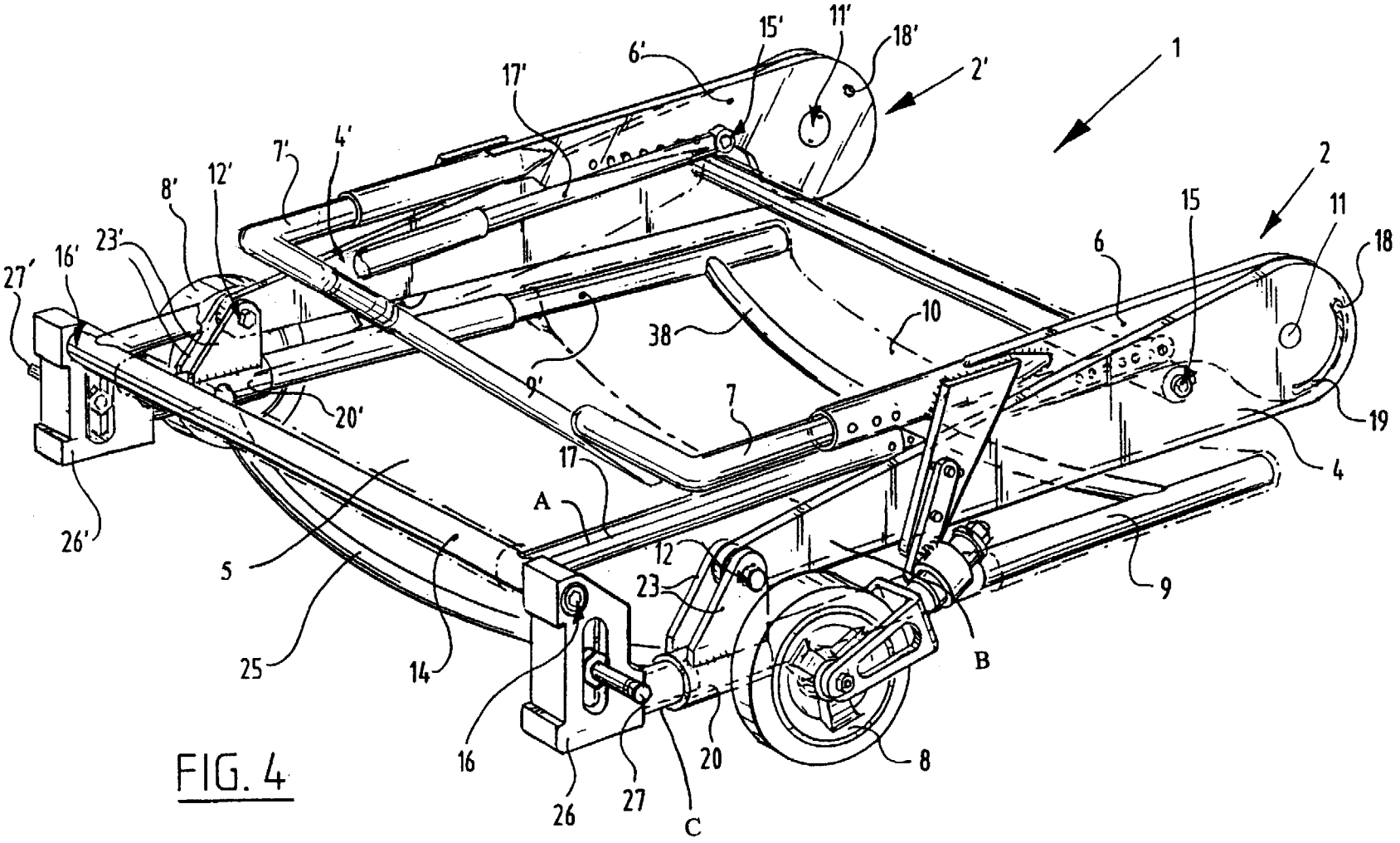
FIG. 4 is a perspective view of the wheelchair in folded state after the rear wheels have been removed.

FIG. 4 shows in perspective view this folded situation.

Figure 5:
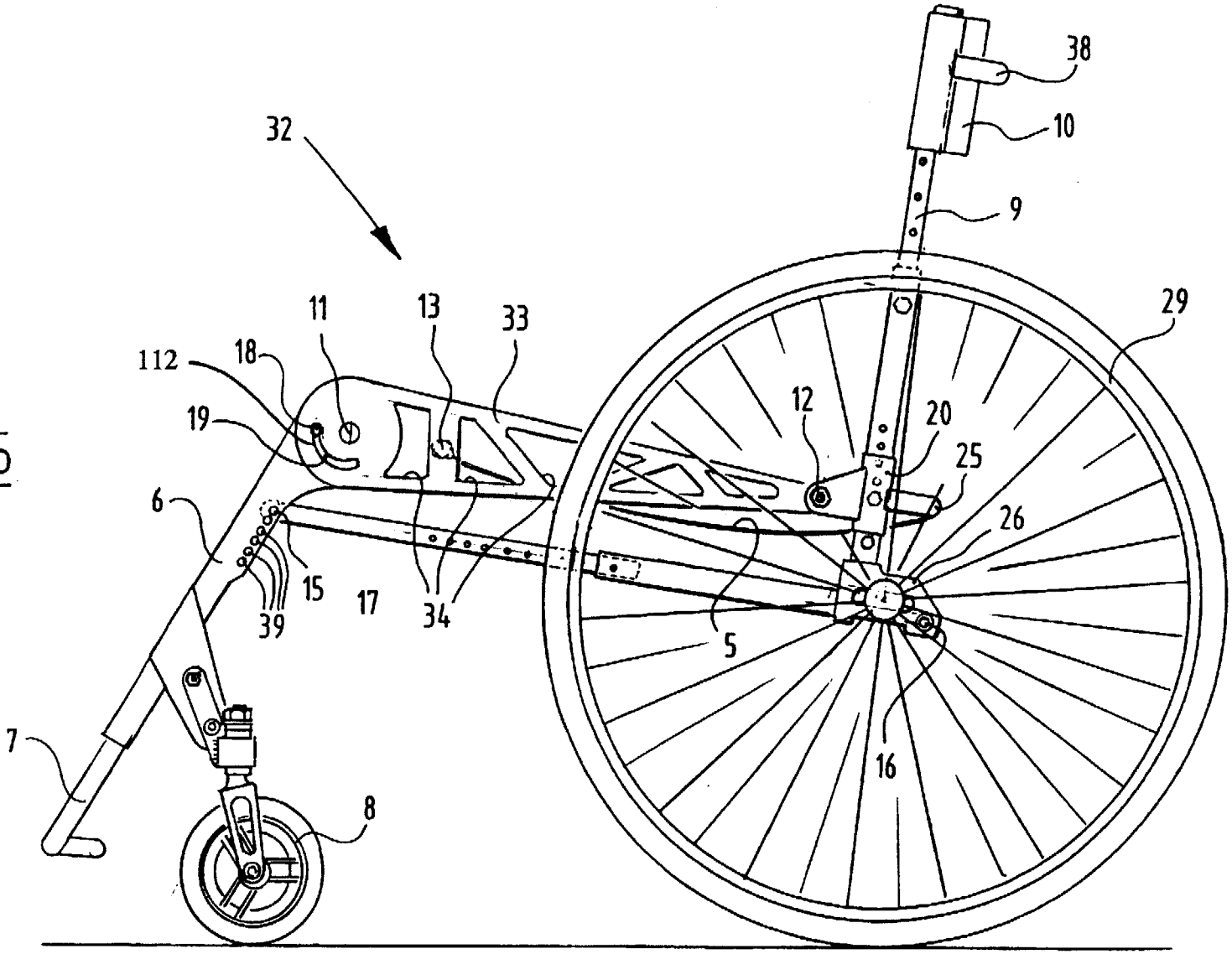
FIG. 5 is a side view of a variant.

FIG. 5 shows a side view of a wheelchair 32 which differs from wheelchair 1 according to FIGS. 1–4 insofar that the first middle sub-frame 33, at variance with sub-frame 4 of FIGS. 1–4, has an open structure. With the perforations, all designated with 34 for the sake of convenience, the bending stiffness is reduced to only a negligible extent, although a considerable weight reduction is realized.

Attention is drawn to the fact that in the situation shown in FIG. 5 and the FIG. 6 to be discussed hereinbelow the blocks 26, 26' have a reversed position. The user hereby acquires a still greater adjustability of the position of rear wheels 29, 29'.

Figure 6:
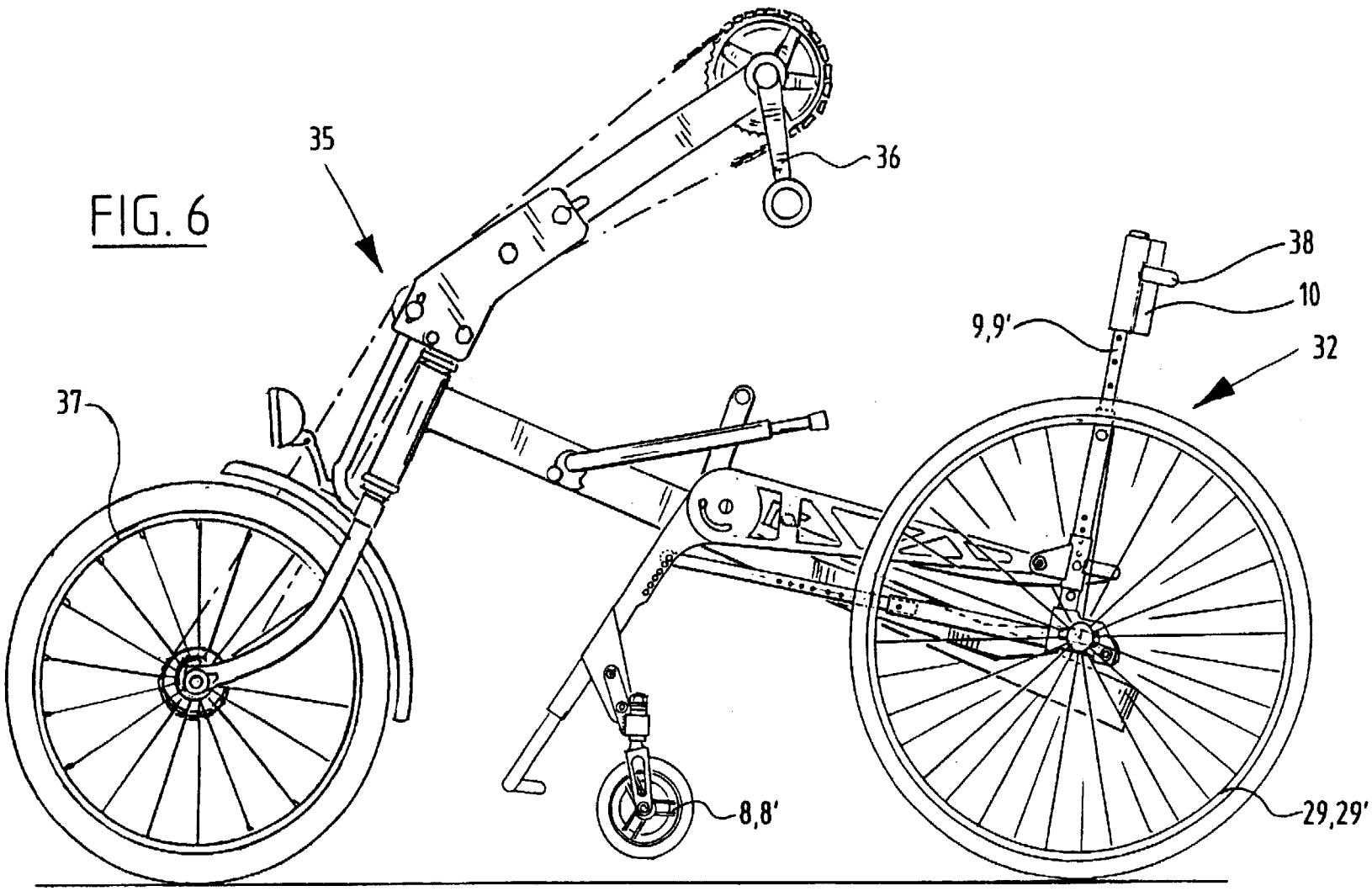
FIG. 6 is a side view of the wheelchair of FIG. 5 which is coupled to an auxiliary device as according to NL-93 01322.

FIG. 6 shows the coupling of wheelchair 32 to an auxiliary device as according to applicant's earlier, as yet unpublished Netherlands patent application NL-93 01322 which is based on the European priority patent application EP-93.201601.1 of 4 Jun. 1993. This auxiliary device 35 can be coupled in a very simple manner to wheelchair 32 and then provides the user with a manual control 36 for driving and steering wheelchair 32 by means of the front wheel 37 forming part of auxiliary device 35. The front wheels 8, 8' of wheelchair 32 are raised from the ground in the coupled situation of wheelchair 32 and auxiliary device 35. The combination 32, 35 therefore travels only on rear wheels 29, 29' and front wheel 37.

Essential to the coupling between auxiliary device 35 and wheelchair 32 is the structure according to the invention, according to which the spacers 13, 14 are freely accessible from the front without this accessibility being obstructed by the presence of a pivotable cross frame as according to the prior art.

The rear sub-frames 9, 9' are coupled at their top, in the region of the seat back 10, by a hand-grip 38 which can serve for manual propulsion of wheelchair 1, 32 by a third party.

Attention is drawn to the fact that block 26 is embodied such that it essentially forms an integrating component of the frame. FIG. 2 in particular shows this aspect clearly. Block 26 is embodied such that it can support the tubular sub-frame 9 with bending stiffness. For this purpose block 26 must be manufactured from a material which can resist the associated mechanical load. Such a material is, for instance, aluminum.

Attention is drawn to the fact that the second middle sub-frame 17 has an adjustable length. In combination with the series of fastening holes 39 corresponding with the positions at which the second middle sub-frame 17 is connected to the front sub-frame 9, this ensures the desired adjustability with the correct collapsibility, i.e., a collapsibility into the position shown in FIG. 4 in which the respective sub-frames lie on top of one another taking up the minimum of space.

The frame of the wheelchair according to the invention is wholly self-supporting and has considerable bending stiffness. A width adjustment is very simple to realize, if desired. The diverse cross connections shown in FIG. 1 between both side frames can be replaced for this purpose with elements with adapted length. These adaptations are wholly linear and correspond exactly with the desired width adjustment. In known collapsible wheelchairs with, for instance, scissor mechanisms, such adaptations are not linear with the desired width adjustment.

Diverse materials are suitable for the frame. These are, for instance, metals, in particular, light metals such as aluminum, plastics, optionally with fiber reinforcement, of great mechanical strength, for instance ABS, in addition to sandwich and composite structures.

It will be further apparent that the spacer 13 can also be arranged at other positions in the vicinity of the hinge joints 11, subject to design considerations.

With reference to the embodiment of FIGS. 5 and 6, it is finally noted that the continuous holes or perforations 34 in the middle sub-frame 33 have dimensions which decrease in transverse direction relative to the longitudinal direction of that sub-frame 33, running from the hinge joint 11 to the hinge joint 12.

Figure 7:
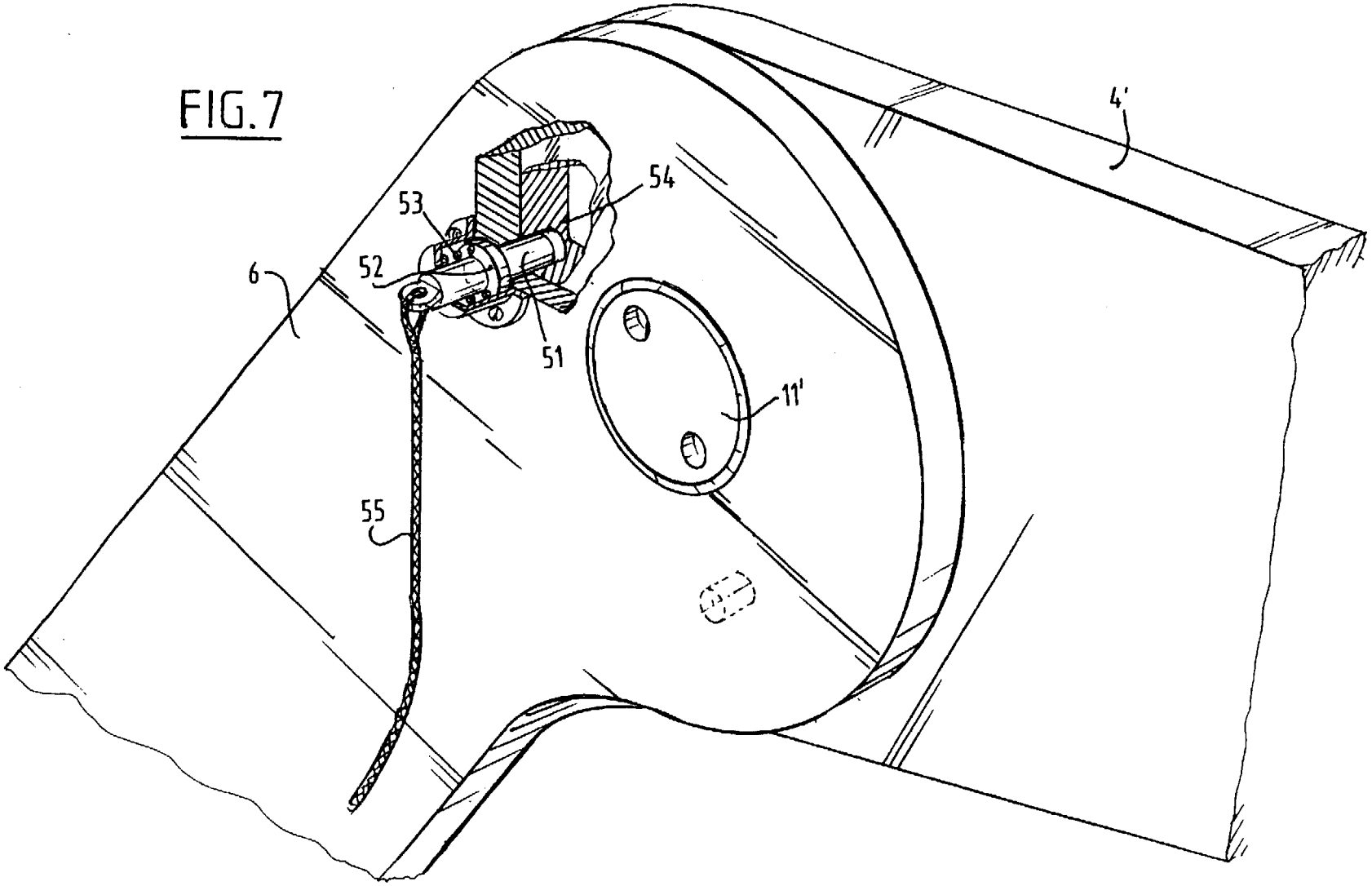
FIG. 7 shows a partly broken away perspective view of a detail of a variant.

FIG. 7 shows that an axially displaceable locking pin or locking member 51 is mounted on both sides in the first sub-frame 6. This comprises a collar 52 which serves as stop for a pressure spring 53 which serves to carry or bias the pin 51 outward into a blind hole or recess 54 which is present in the middle sub-frame 4' and with which the pin 51 can thus co-act for locking the frame in an open position. In this manner, the spring 53 urges the pin 51 into the hole 54 when the pin is aligned with the hole 54. As a result of the distance between the hinge joint 11' and the pin-hole connection 51, 54 the sub-frames 4', 6 are mutually connected so as to be locked against rotation. A cord 55 mutually connects the pins 51 in the left and right-hand frame. By exerting a pulling force on cord 55, a user can pull the pins 51 inward counter to the action of the respective springs 53 so that the pins 51 are moved out of the holes, whereby the hinge locking between sub-frames 4', 6 is disengaged and the wheelchair can be closed or collapsed to a first position as shown in FIG. 4. One of the frame members, such as sub-frame 6, is moved toward one of the other frame members, such as sub-frame 9 after disengagement so that the wheelchair can be collapsed from an open position. In this manner, portions A, B and C of at least three of the frame members are positioned above another without collapsing the seat 5 (see FIG. 4). The sub-frame 6 is moved away from the sub-frame 9 when the frame is opened from the collapsed position to the open or second position, as shown in FIG. 1. In the second position, the stopping member prevents further movement of the frame members relative to each other (see FIG. 5). In this arrangement, the locking pin 51 automatically engages into blind hole 54 when the frame is in the open position so that the frame cannot be collapsed unless the locking member is disengaged. As can be seen in FIG. 4, the back 10 and the seat 5 extend in substantially the same direction when the frame is in the closed position. As shown in FIG. 1, the seat 5 and back 10 extend in substantially different directions, i.e., transverse directions, when the frame is in the open position. As can be seen in FIGS. 4 and 5, non-adjacent frame members 9 and 6 move toward each other during closing of the wheelchair frame from an open position and move away from each other during the opening of the wheelchair from a closed position. The same is true for non-adjacent frame members 4 and 17.

Figure 9:
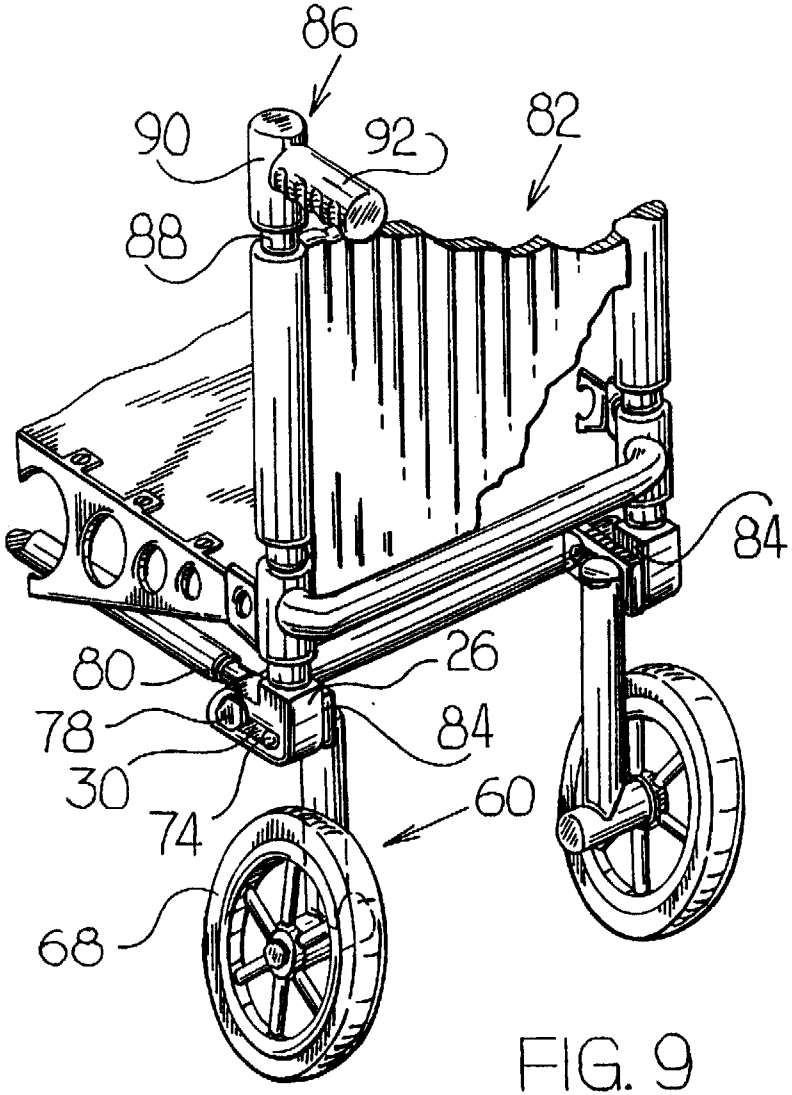
FIG. 9 is a perspective view of the passive wheel assembly of FIG. 8 attached to a wheelchair.
Figure 8:
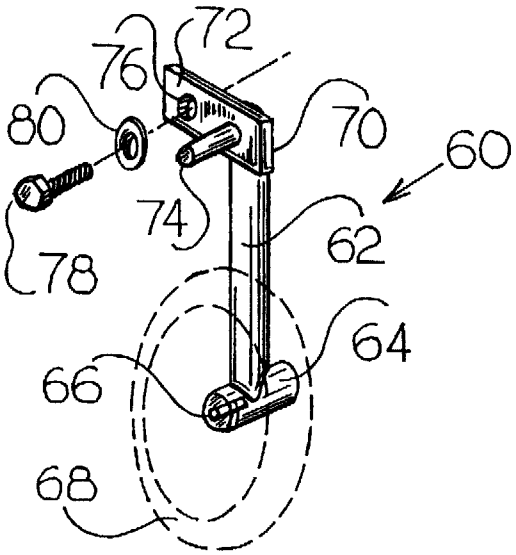
FIG. 8 is a perspective view of a passive wheel assembly.

FIGS. 8 and 9 disclose a passive wheel assembly 60 which may be used to convert a wheelchair as previously shown in FIGS. 1–7 from an active to a passive mode. As shown in FIG. 8, the passive wheel assembly 60 includes a tubular support 62 having a wheel attachment element 64 attached to one end thereof. The wheel attachment element 64 includes a central bore 66 to rotatably carry the axle of a passive rear wheel 68 in conventional manner. A chair attachment member 70 is attached to the other end of the tubular support 62. The attachment member 70 includes a front face 72 having an attachment peg 74 extending substantially perpendicularly therefrom. The attachment member 70 further includes a blind, threaded bore 76 configured to engage a threaded bolt 78. A lock washer 80 is carried on threaded bolt 78.

To attach the passive wheel assembly 60 to a wheelchair 82 as previously described, the attachment peg 74 is inserted into the hole 30 in the block 26 such that the front face 72 of the attachment member 70 abuts an inner side 84 of the block 26. The passive wheel assembly 60 is then adjusted to align the bore 66 with the hole 30 in the block 26 and then the threaded bolt 78 with the lock washer 80 is inserted through the hole 30 in the block 26 to engage the bore 66 in the attachment member 70. As shown in FIG. 9, the peg 74 and the bore 66 are spaced from each other such that when the passive wheel assembly 60 is attached to the block 26 of the wheelchair 82, the attachment peg 74 and threaded bolt 78 abut the opposed ends of the hole 30 to stably support the passive wheel assembly 60. To remove the passive wheel assembly 60, the threaded bolt 78 is removed and the passive wheel assembly 60 is disengaged from the block 26. Thus, the wheelchair 82 may be quickly and easily switched from a passive wheel configuration to an active wheel configuration as shown, for example, in FIG. 1.

In the passive mode, the wheelchair 82 further includes a removable hand grip assembly 86 which may be removably attached to the upper portion 88 of the rear sub-frame 9. The hand grip assembly 86 includes a hollow cylindrical sleeve 90 having a hand grip 92 extending substantially perpendicularly therefrom.

Figure 10:
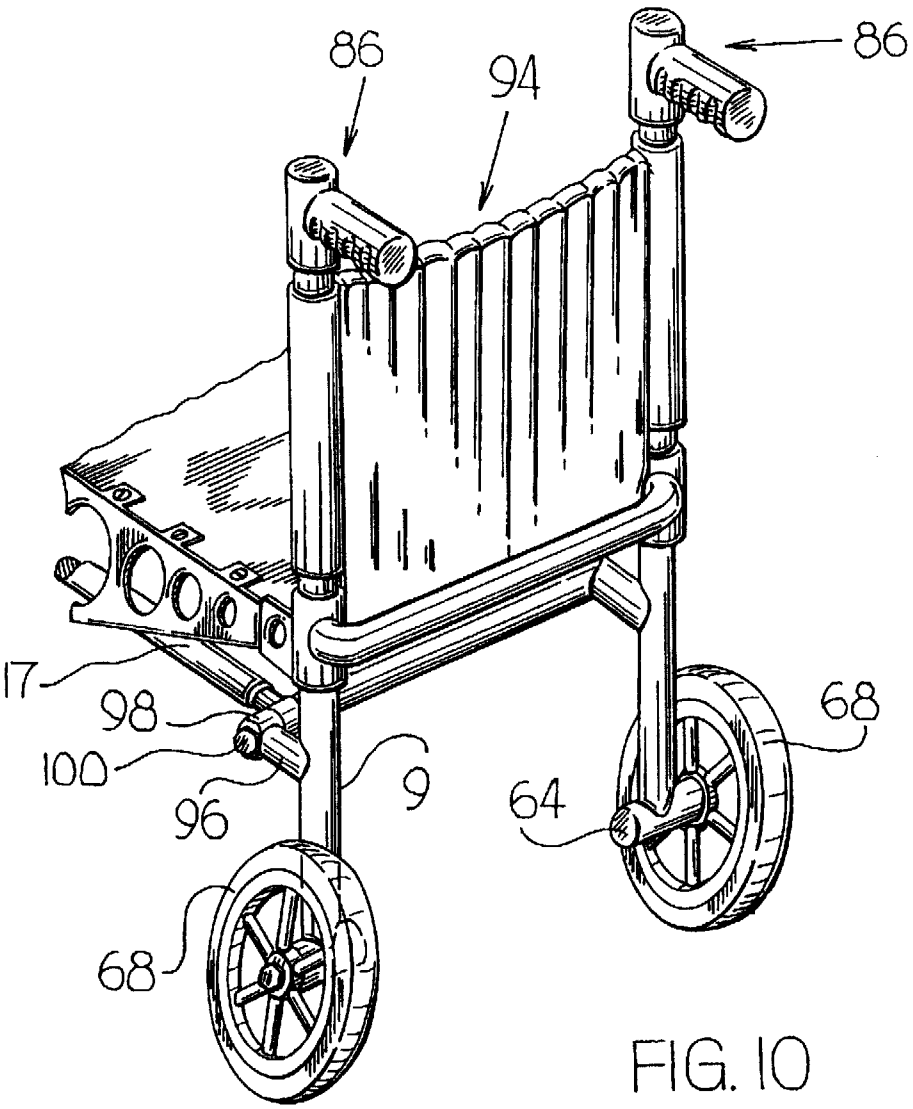
FIG. 10 is a perspective view of a passive wheelchair.

FIG. 10 shows a passive wheelchair 94 which is not convertible into an active mode. The wheelchair 94 does not include a block 26. The rear sub-frame 9 is longer than that of the previously described embodiments and a wheel attachment element 64 is attached to the lower end of the rear sub-frame 9. A passive rear wheel 68 is attached to the wheel attachment element 64 on the rear sub-frame 9. An attachment tube 96 extends from the rear sub-frame 9 and is pivotally attached to the spacer 14 by, for example, a collar 98. The attachment tube 96 is attached to the spacer 14 by, for example, a bolt 100. A hand grip assembly 86 is attached to the top of each rear sub-frame 9.

We claim:

1. A collapsible wheelchair comprising:

a frame comprising:

a first side frame;

a second side frame substantially the same as the first side frame;

coupling means holding the two said side frames at a mutual distance in at least an operative situation;

wheels arranged on the frame;

a seat;

a seat back; and wherein each side frame comprises:

a first middle sub-frame which in the operative situation extends substantially horizontally, at substantially a level of the seat;

a front sub-frame which in the operative situation extends from a front side of the first middle sub-frame inclining downwardly in a forward direction and bears a front wheel;

a rear sub-frame which in the operative situation extends from a rear side of the first middle sub-frame and bears a rear wheel, wherein the front and rear sub-frames are pivotable relative to the first middle sub-frame by respective hinge joints and the coupling means are configured as spacers holding corresponding sub-frames at a fixed distance;

a second middle sub-frame arranged between the front and rear sub-frames for pivoting relative to both these sub-frames by a hinge joint such that each side frame, and thus the whole frame, is foldable around pivot axes until the front, first middle and rear sub-frames lie substantially on top of each other; and stop means located between the middle sub-frame and at least one of the other sub-frames.

2. The wheelchair as claimed in claim 1, wherein the location of the hinge joint between the first middle sub-frame and the rear sub-frame is adjustable along the rear sub-frame.

3. The wheelchair as claimed in claim 1, wherein the location of the hinge joint between the second middle sub-frame and the front sub-frame is adjustable along the front sub-frame.

4. The wheelchair as claimed in claim 1, wherein the length of each second middle sub-frame is adjustable.

5. The wheelchair as claimed in claim 1, wherein each side frame lies in a respective main plane and at least in a zone of each first middle sub-frame adjacent the hinge joint pivotally joining the respective first middle sub-frames to the respective front sub-frames, the first middle sub-frames have a larger dimension in the respective main planes than in a direction transverse to the respective main planes for increasing the bending stiffness in the main planes.

6. The wheelchair as claimed in claim 5, wherein in the zone of each first middle sub-frame adjoining the hinge joint pivotally joining the respective first middle sub-frames to the respective front sub-frames, each front sub-frame has a larger dimension in the respective main planes than in the direction transverse to the respective main planes for increasing the bending stiffness in the main planes.

7. The wheelchair as claimed in claim 1, wherein the rear wheels are releasably coupled to the rear sub-frames by a rapid-action coupling.

8. The wheelchair as claimed in claim 7, wherein each rear sub-frame includes a releasable block which supports a shaft to which one of the rear wheels is releasably coupled, which block supports the shaft at an angle determining an alignment angle of the rear wheel coupled thereto.

9. The wheelchair as claimed in claim 8, wherein the position of the shaft is adjustable in a travel direction of the rear wheel coupled thereto.

10. The wheelchair as claimed in claim 1, wherein the two first middle sub-frames are connected by a first spacer.

11. The wheelchair as claimed in claim 8, wherein each block is hingedly connected to a respective second middle sub-frame and the two second middle sub-frames are connected by a second spacer.

12. The wheelchair as claimed in claim 1, wherein the two rear sub-frames are connected by a third spacer in a zone of the rear sub-frames adjoining the first middle sub-frames.

13. The wheelchair as claimed in claim 1, wherein the stop means comprises a pin axially displaceable by an actuating assembly counter to the action of a spring, which pin is mounted in one of the sub-frames and is configured to be in locking co-action with a hole in an adjacent sub-frame.

14. The wheelchair as claimed in claim 13, wherein two pins are present at corresponding positions in both side frames.

15. The wheelchair as claimed in claim 14, wherein the two pins are connected by a flexible pulling member such that by exerting a pulling force on the pulling member a user can move both pins out of locking co-action with the respective holes counter to the action of the respective springs.

16. The wheelchair as claimed in claim 1, further including means for locking the wheelchair in the stable operating position.

17. A wheelchair comprising:

a frame;

a plurality of wheels rotatably secured to said frame; and a seat secured to said frame, said frame comprising:

a first member;

a second member pivotally secured to said first member;

a third member pivotally secured to said second member;

a fourth member pivotally secured to said first member and said third member;

a stop secured to said frame; and a locking member secured to said frame, whereby said frame is adapted to collapse in a first position when said first member is moved toward said third member so that portions of at least three of said members are positioned above one another without collapsing said seat, and whereby said frame is adapted to open into a second position when said first member is moved away from said third member, said stopping member preventing further movement of said frame members relative to each other and said locking member automatically engaging when said frame members are in said second position so that said frame cannot be collapsed unless said locking member is disengaged.

18. A wheelchair as claimed in claim 17, wherein said locking member comprises:

an axially displaceable pin, said pin slidably mounted on one of said first member, second member, third member and fourth member and said pin adapted to engage in a recess provided in one of said other of said first member, second member, third member and fourth member, whereby said frame is locked in said second position when said pin is engaged.

19. A wheelchair as claimed in claim 18, wherein said pin is spring biased so as to urge said pin into said other member recess when said pin is aligned with said recess.

20. A wheelchair as claimed in claim 19, wherein said pin is connected to a flexible pulling member, whereby a user can move said pin out of said recess of said other member to counter the bias of said spring by extending a pulling force on said locking member thereby disengaging said locking member.

21. A wheelchair as claimed in claim 17, wherein said stop comprises:

a first stop portion defined on one of said first member, second member, third member and fourth member, and a second stop portion defined on another one of said first member, second member, third member and fourth member, whereby when said frame is opened into said second position said first portion contacts said second portion so that said first member cannot be further moved away from said third member.

22. A wheelchair as claimed in claim 21, wherein said first portion is a surface defining a slot and said second portion is a pin received by said slot and adapted to abut against said surface in said second position.

23. A wheelchair as claimed in claim 17, wherein said first member, second member, third member and fourth member form a first side frame, said frame further comprising a second side frame comprising a fifth member, a sixth member pivotally secured to said fifth member, a seventh member pivotally secured to said sixth member and an eighth member pivotally secured to said fifth member and said seventh member, wherein said first side frame is coupled to said second side frame.

24. A wheelchair as claimed in claim 17, wherein one of said first member, second member, third member and fourth member is an L-shaped member, said L-shaped member includes two legs and two of said other of said first member, said second member, said third member and said fourth member are pivotally attached to respective legs of said L-shaped member.

25. A wheelchair as claimed in claim 17, further comprising:

a back secured to said frame, whereby said seat and said back extend in substantially the same direction when said frame is in said first position, said seat and said back extend in substantially different directions when said frame is in said second position.

* * * * *